United States Patent [19]

Cobb et al.

[11] 4,423,854

[45] Jan. 3, 1984

[54] ROADWAY BARRIER

[75] Inventors: Lincoln C. Cobb, Dallas, Tex.; Raymond A. Wardell, Downsview, Canada

[73] Assignee: International Barrier Corporation, Toronto, Canada

[21] Appl. No.: 203,819

[22] Filed: Nov. 7, 1980

Related U.S. Application Data

[63] Continuation-in-part of Ser. No. 97,228, Nov. 26, 1979, abandoned.

[51] Int. Cl.[3] ..... A01K 3/00

[52] U.S. Cl. ..... 256/13.1

[58] Field of Search ..... 256/1, 13.1

[56] References Cited

U.S. PATENT DOCUMENTS

| | | | |
|---|---|---|---|
| Re. 29,544 | 2/1978 | Fitch | 256/13.1 |
| 376,936 | 1/1888 | Barton | 256/19 X |
| 640,377 | 1/1900 | Haentges . | |
| 1,937,781 | 12/1933 | Patton . | |
| 2,919,045 | 12/1959 | Waugh et al. | 220/4 |
| 3,288,440 | 11/1966 | Schimmelpenninck | 256/13.1 |
| 3,643,924 | 2/1972 | Fitch | 256/13.1 |
| 3,856,268 | 12/1974 | Fitch | 256/13.1 |
| 3,880,404 | 4/1975 | Fitch | 256/1 |
| 3,916,816 | 11/1975 | Fitch | 116/63 P |
| 3,983,956 | 10/1976 | Manhart | 181/33 G |
| 4,073,482 | 2/1978 | Seegmiller et al. | 267/139 |
| 4,138,095 | 2/1979 | Humphrey | 256/1 X |
| 4,361,313 | 11/1982 | Russell . | |

FOREIGN PATENT DOCUMENTS

| | | | |
|---|---|---|---|
| 21668 | 5/1885 | Canada . | |
| 26682 | 5/1887 | Canada . | |
| 161947 | 4/1915 | Canada . | |
| 189784 | 6/1918 | Canada . | |
| 840107 | 4/1970 | Canada . | |
| 2317812 | 12/1973 | Fed. Rep. of Germany . | |
| 2908818 | 9/1979 | Fed. Rep. of Germany | 256/13.1 |
| 776756 | 11/1934 | France . | |
| 395442 | 7/1933 | United Kingdom . | |
| 915133 | 2/1960 | United Kingdom . | |
| 1055341 | 1/1967 | United Kingdom . | |
| 1298957 | 12/1969 | United Kingdom . | |
| 1237445 | 6/1971 | United Kingdom . | |
| 1364885 | 11/1972 | United Kingdom . | |
| 1349076 | 3/1974 | United Kingdom . | |
| 1446152 | 8/1976 | United Kingdom . | |
| 1474787 | 5/1977 | United Kingdom . | |
| 1504926 | 3/1978 | United Kingdom . | |
| 1560563 | 2/1980 | United Kingdom . | |

OTHER PUBLICATIONS

Report for Fed. Highway Admin. Titled "Molded Fiberglass Median Barrier" Dec. 1974.

Brochure Titled "The Fitch Inertial Barrier System". Introducing a New and Better Shoulder and Median Barrier System.

International Barrier Corporation Test Report.

MTC News.

*Primary Examiner*—Andrew V. Kundrat

*Attorney, Agent, or Firm*—Arnold, White & Durkee

[57] ABSTRACT

A roadway barrier component adapted to be assembled on a supporting surface with corresponding barrier components removably connected to opposed ends thereof for forming an elongated dismountable roadway barrier for flanking a roadway, the barrier being deformable under vehicle impact to gradually redirect a straying vehicle coming into contact therewith. The barrier component includes a pair of panels to be positioned along a lower edge of each panel on such a supporting surface in laterally spaced relationship to define a filler cavity between their internal surfaces for receiving a displaceable ballast material to support the component on such a supporting surface and to provide a medium for dissipating impact energy during use, and panel connection means for removably connecting the panels together in their laterally spaced relationship; each panel having panel fitting zones for use in removably connecting the panels of the barrier component to panels of corresponding barrier components to form an elongated roadway barrier having at least one elongated outer surface which is generally smooth and free of outwardly projecting obstructions in at least one direction parallel to the length of the barrier; and the barrier component being adapted to provide a lesser impact resistance in a lower zone than in a central impact zone of the barrier component during vehicle impact therewith to combat vehicle ramping.

58 Claims, 7 Drawing Figures

ROADWAY BARRIER

CROSS REFERENCE TO RELATED APPLICATION

This application is a continuation-in-part application of our co-pending application Ser. No. 097,228 filed Nov. 26, 1979 and now abandoned.

This invention relates to a roadway barrier. More particularly, this invention relates to a roadway barrier component, to apparatus for forming a roadway barrier, and to a roadway barrier.

The roadway barrier of this invention may serve particularly as a barrier for flanking a roadway or as a median barrier between adjacent roadways. It will be appreciated, however, that the barrier of this invention may have various other applications.

Roadway barriers are generally in the form of permanent installations such as heavy concrete barriers or metal guard rails. These present the disadvantage that repair and replacement as a result of impact damage is expensive and time consuming. In addition, these permanent installations do not lend themselves to dismantling and are therefore not suited for use as temporary removable barriers.

Additionally, each system has functional limitations which can lead to severe damage to impacting vehicles and to occupants of such vehicles.

Concrete barriers of the prevalent New Jersey profile type have been shown to be effective in redirecting large conventional passenger vehicles without any undue tendency to overturn such vehicles. However, substantial vehicle damage can result due to rapid deceleration and sharp redirection by such barriers. Such concrete barriers have, however, in full scale tests and in application, shown a tendency to overturn smaller sized automobiles. Partly because of this tendency, little if any such concrete median barrier is in use in Europe, where automobiles are generally smaller than in North America. As cars are being downsized, this overturning tendency shown by the New Jersey profile concrete median barrier will become a more commonly exhibited characteristic.

Steel guard rails can generally be designed to function reasonably well over a relatively narrow range of impact severity, based on vehicle size, weight, speed, and angle of impact. They, however, can show alarming ramping tendencies under circumstances differing from the design ideal. Steel guard rail is also expensive to install, repair, and maintain.

According to this invention there is provided a roadway barrier component adapted to be assembled on a supporting surface with corresponding barrier components removably connected to opposed ends thereof for forming an elongated dismountable roadway barrier for flanking a roadway, the barrier being deformable under vehicle impact to gradually redirect a straying vehicle coming into contact therewith, the barrier component comprising:

(a) a pair of panels to be positioned along a lower edge of each panel on such a supporting surface in laterally spaced relationship to define a filler cavity between their internal surfaces for receiving a displaceable ballast material to support the component on such a supporting surface and to provide a medium for dissipating impact energy during use;

and (b) panel connection means for removably connecting the panels together in their laterally spaced relationship;

each panel having panel fitting zones for use in removably connecting the panels of the barrier component to panels of corresponding barrier components to form an elongated roadway barrier having at least one elongated outer surface which is generally smooth and free of outwardly projecting obstructions in at least one direction parallel to the length of the barrier; and the barrier component being adapted to provide a lesser impact resistance in a lower zone than in a central impact zone of the barrier component during vehicle impact therewith to combat vehicle ramping.

At least one panel may be so adapted to provide a lower zone of lesser impact resistance by that panel having its lower zone recessed inwardly of its outer surface or of its central impact zone to delay contact between the lower zone and a vehicle striking the barrier during impact.

Conveniently, the lower zone may be recessed sufficiently so that a vehicle striking the formed barrier under average conditions would tend to cause lateral displacement of the portion of the barrier under impact before the panel under impact will have been deformed sufficiently to allow the vehicle to come into contact with the lower portion.

In this way the tendency for the lower zone of the panel to be deformed upwardly and outwardly relatively to the remainder under impact and to come into contact with an impacting vehicle to create a ramping effect will tend to be reduced.

In an alternative embodiment of the invention, to achieve the same objective, the component may be so adapted to provide a lower zone of lesser impact resistance by the component including collapsing means for causing preferential collapsing of the lower zone under impact.

Thus as a vehicle strikes a panel in a formed barrier, the lower zone will be caused to collapse preferentially to the remainder of the panel thereby again combating a ramping effect.

Various alternative forms of collapsing means may be provided.

In one example of the invention, the collapsing means may comprise a collapsing material to be located between the panels in the lower region during use, the collapsing material having a resistance to displacement which is less than that of a ballast material to be provided in the filler cavity.

Thus, for example, the the collapsing material may comprise a hollow tubular member. Alternatively, for example, it may comprise a tubular member containing a collapsible material.

In yet a further example of the invention, the collapsing means may comprise a material having a lesser density than the intended ballast material, either in particulate form, in the form of an elongated strip, or housed within a tubular member.

The collapsing means may preferably be such that it can effectively support the weight of ballast material but will readily collapse or be dispersed under impact preferentially to displacement of the ballast material to cause preferential collapsing of the lower region.

The collapsing material may preferably be such that when positioned within the barrier component during use, and when supporting a ballast material contained within the filler cavity during use, the barrier component will have its center of gravity disposed at a height approaching that of an average vehicle.

An average small sized passenger vehicle usually has its center of gravity at a height of about 20 to 22 inches, while a large size passenger vehicle usually has its center of gravity at a height of about 23 to 25 inches. The formed barrier may therefore have its center of gravity at a height of at least about 15 to 20 inches, and preferably between about 24 and 27 inches.

Each panel will preferably have a tensile strength to allow deformation but resist penetration under the average type of impact which will be provided by a vehicle during use.

In an embodiment of the invention at least one panel may have a central zone above the lower zone, which is bulged outwardly relatively to its lower zone, or relatively to its upper and lower zones to provide a primary impact zone. In this embodiment, the central impact zone may conveniently be reinforced in that zone to provide resistance to penetration under impact.

Such reinforcement may be effected by a reinforcing strip, which may be curved, such as, for example, of corrugated or W-section, which is fixed to the panel or is integrally formed in the panel.

In an alternative example of the invention the central impact zone may be reinforced by the panel having corrugation or like formations in that zone. In a further example, the panel may comprise upper and lower panel sections with each section having corrugating formations along one elongated edge zone, and the corrugating formations may be overlapped to form the reinforced corrugated central impact zone of the panel.

The corrugated formations are peferably arranged to be engaged by a vehicle front during impact to restrain the vehicle front from lifting.

Where the panel comprises upper and lower panel sections having corrugations, a corrugated panel, which may be of greater thickness, may be interposed between the upper and lower panel sections and may be partially overlapped with the corrugations of the upper and lower sections to permit effective adjustment of the height of the composite panel.

Each panel may preferably have an inturned flange proximate its lower edge to be directed inwardly during use, each flange being such as to be capable of being engaged by ballast material to restrain lifting of the panels under impact during use.

Alternatively, if desired, each panel may have a tubular or channel section flange along its lower edge.

The component may include barrier connection means which is separate from the panel connection means, and which is fixed to or engageable with the panel fitting zones for use in connecting the ends of the panels to corresponding panels for forming an elongated barrier.

In a preferred embodiment, however, the panel connection means may be adapted to cooperate with the panel fittings to connect the panels in their laterally spaced relationship and to connect barrier components together.

In an embodiment of the invention the panel connection means may be such as to limit its affect upon a vehicle striking the component and deforming a panel of the component during use.

Thus, the tendency for the panel to be displaced inwardly under impact beyond the connection means resulting in the connection means forming outwardly projecting obstructions to a vehicle sliding along the barrier will be combated.

The connection means may, for example, be so adapted by having at least one deformable portion having a resistance to deformation generally approaching that of the panels. Thus deformation of the connection means with the panel will occur to prevent the connection means from acting as a transverse obstruction to a vehicle upon impact.

In an alternative example, the connection means may be so adapted by being adapted to be positioned in its operative position inwardly spaced from the inner surfaces of the panels or at least inwardly spaced from the outer surface of the central impact zone to allow a degree of deformation of the panels prior to contact of the deformed panels with the connection means.

The panel fitting zones may be in the form of zones where panel fittings can be fixed, where fitting apertures may be formed, or may be in the form of apertures in the panels, or in the form of apertures in panel fittings integral with or fixed to the panels.

Various specific types of panel fittings may be provided for engaging with the connection means.

Thus, for example, the panel fittings and connection means may have complementary mating or engagement formations which can be engaged.

In one embodiment, the panel fittings may be in the form of brackets which are connected to the panels or are integrated with the panels, and which have locating apertures for cooperating with corresponding pin or hook formations of the connection means.

It will be appreciated that any of the various other types of complementary engagement systems known to those skilled in the art may be employed.

In a preferred embodiment of the invention, the panel fitting zones comprise spaced sets of zones provided proximate opposed end regions of each panel, with the sets of zones at opposed ends of each panel being arranged complementarily to each other to allow mating with the sets of zones of a corresponding panel when positioned at either end thereof.

The panel connection means may, in one preferred embodiment, comprise at least one connection link member to extend between the panel fitting zones at one end of the pair of laterally spaced panels, and locking pins to lock the link member in position.

In an alternative preferred embodiment of the invention the panel connection means may comprise a bulkhead panel having opposed sides of complementary configuration to the panels to mate with the panels. The bulkhead panel may be of sheet material, may have transversely bent edges, and may have apertures therein.

In this embodiment of the invention the panel connection means may include removable locking pins for engaging with the bulkhead panel and the panels, with the aid of locking brackets if desired, to connect the bulkhead panel removably to the panel.

In yet a further alternative embodiment of the invention the panel connection means may comprise tubular or planar link members and flexible connection members in the form of chains, wire rope or the like to cooperate with the link members and to connect the panels of a component in their laterally spaced relationship while at the same time connecting corresponding panels to the panels of the component.

The panel connection means and the panel fittings or panel fitting zones may, in an embodiment of the invention be such as to provide connections which have a degree of flexibility to permit a degree of articulation between panels of adjacent barrier components to allow for changes in elevation or for roadway curvature.

The panels may be of differing lengths or may be curved transversely to their lengths, to allow formation of a roadway barrier which is curved along its length.

Further according to the invention there is provided apparatus for forming on a supporting surface an elongated dismountable roadway barrier for flanking a roadway, which is deformable under vehicle impact to gradually redirect a straying vehicle coming into contact therewith, the apparatus comprising:

(a) a plurality of panels adapted to be arranged in two generally parallel spaced rows along lower edges of the panels on such a supporting surface to define a filler cavity between them for housing a displaceable ballast material to support the roadway barrier when formed and provide a medium for dissipating impact energy, and (b) panel connection means to be engaged with the panels to locate two such rows in their spaced relationship, and to connect the panels in each row in end-to-end relationship to form an elongated linked row;

at least the panels to be placed in one row being adapted, when connected, to present an outer surface for the row which is generally smooth and free of outwardly projecting obstructions in at least one direction parallel to the length of the linked row;

and the apparatus when assembled and when housing a ballast material in the filler cavity, being adapted to provide a lesser impact resistance in a lower zone adjacent the lower edge than in a central impact zone in at least one linked row during vehicle impact therewith, to thereby combat vehicle ramping.

The invention further extends to an elongated dismountable roadway barrier positioned on a supporting surface to flank a roadway, the barrier being deformable under impact to gradually redirect a straying vehicle striking the barrier, the barrier comprising:

(a) a plurality of panels arranged in two generally parallel spaced rows along lower edges of the panels to define a filler cavity between them;

(b) connection means engaged with the panels thereby locating the rows in their laterally spaced relationship, and connecting the panels in each row in end-to-end relationship in an elongated linked row with the barrier presenting outer surfaces which are generally smooth in a direction parallel to the length of the barrier to allow a vehicle striking the barrier to be deflected along the length of the barrier;

(c) a displaceable ballast material housed in the filler cavity to provide a medium for dissipating impact energy and to support the barrier;

and (d) collapsing means in a lower region of the barrier adjacent its lower edge to cause the lower region of a row to collapse preferentially to a central region of that row above the lower region upon impact.

The ballast material to be used in the barrier of this invention may be selected from a variety of displaceable ballast materials. Thus, for example, the displaceable ballast material may be any suitable particulate, dispersible, non-self supporting or fluent material.

The particular selection of displaceable ballast material will be governed largely by economic considerations and availability.

In specific examples of the invention, the ballast material may be in the form of sand, soil, crushed rock or shingle, crushed rubble, or the like.

It will be appreciated that the ballast material may also be water if suitable containing means for containing water is provided within the filler cavity.

The panels of this invention may be made of a variety of materials such as, for example, sheet metal, mild steel sheet, aluminum alloy sheeting, reinforced fiberglass, synthetic plastics material, or a reinforced synthetic plastics material.

In an embodiment of the invention, the panels may be made of mild steel or aluminum alloy sheeting, and may have their outer surfaces or direct impact zones of their outer surfaces coated or covered with a reinforcing material to improve resistance to penetration under impact.

The reinforcing material may, for example, comprise a reinforced synthetic plastics material, a reinforced synthetic rubber, or the like.

In a preferred embodiment of the invention, the panels are made of mild steel sheet having a thickness of between about 9 and 16 gauge, and preferably having a thickness of between about 12 and 14 gauge.

The height and length of the panels will be governed by roadway conditions, by vehicle speeds, and by ease of handling and transportation of the panels.

In a typical embodiment of the invention, each panel will have a height of about 42 inches, a length of about 9½ feet, and the barrier will be formed so that it has a width of at least about 3 feet, and conveniently between about 3 and 5 feet depending upon roadway conditions.

Preferred embodiments of the invention are now described by way of example with reference to the accompanying drawings.

Figure 1:
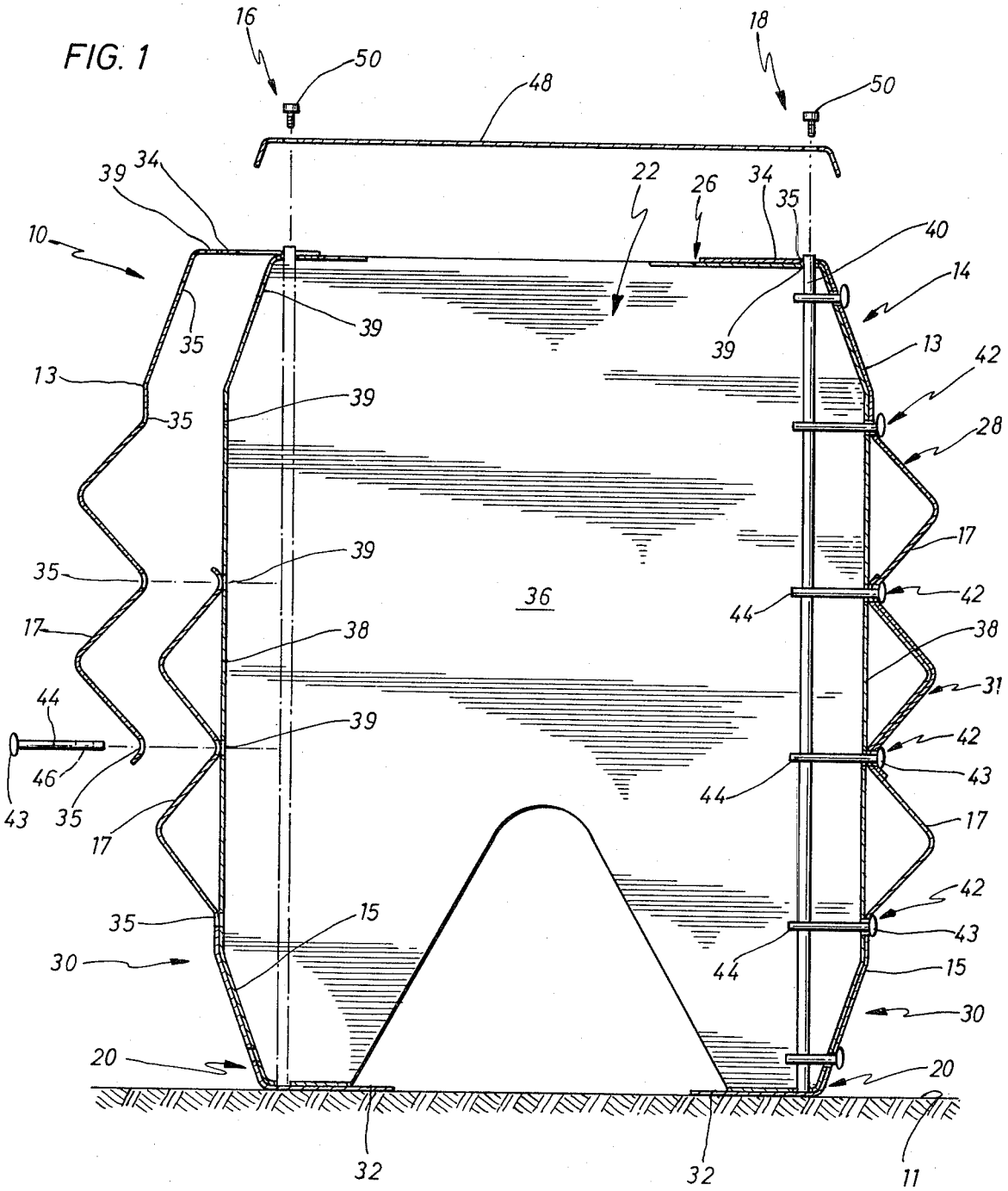
FIG. 1 shows a partly exploded, fragmentary end elevation of one embodiment of an assembled barrier component in accordance with this invention before being filled with a ballast material.
Figure 2:
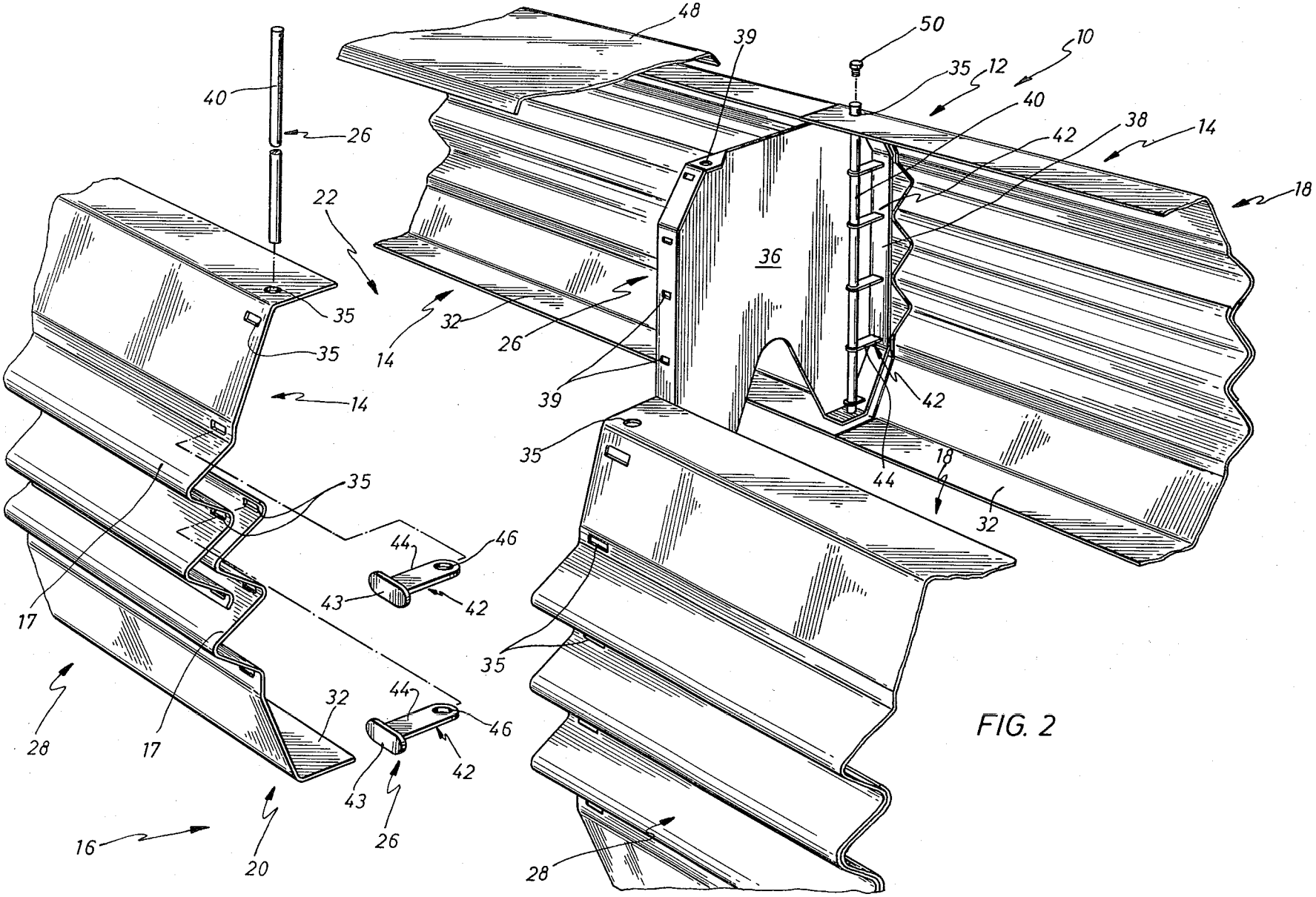
FIG. 2 shows a fragmentary, three-dimensional, partly exploded view of the component of FIG. 1 with the lid omitted for the sake of clarity.

With reference to FIGS. 1 and 2 of the drawings, reference numeral 10 refers generally to apparatus for forming on a supporting surface an elongated dismountable and displaceable roadway barrier 12 for flanking a roadway.

The barrier 12 may be formed on the side of a roadway or, in the embodiment shown in the drawings, on the median between two adjacent highways to separate the highways.

The purpose of the barrier 12 is to deform under vehicle impact to absorb impact energy and to thus gradually deflect a straying vehicle coming into contact therewith. The barrier 12 is designed to redirect a vehicle sufficiently slowly with a view to minimizing damage caused to such a vehicle and injury caused to its occupants. In the preferred embodiment of the invention, the barrier 12 is such that it will be deformed under low impact conditions such as by a small vehicle or by a vehicle travelling at a relatively low speed, but will be capable of being displaced laterally after deformation under high impact conditions to better absorb high impact energy.

The barrier 12 has the further object of preventing a vehicle striking the barrier from being deflected over the barrier onto the other highway or from being deflected rapidly back onto the highway on which it originally was, thereby reducing the risk of further collision with other vehicles.

Since roadside space is usually limited, particularly in the case of a median, the extent to which the barrier 12 can be displaced laterally under impact should be limited. On the other hand, unless the barrier can be shifted laterally under impact, it cannot usually absorb high impact energy sufficiently slowly to limit damage to impacting vehicles and the occupants of such vehicles within acceptable limits, and will usually tend to deflect impacting vehicles rapidly and hazardously back onto the roadway, or allow vehicles to penetrate or vault the barrier with further hazardous consequences.

It follows therefore that in the preferred embodiment of the invention, to provide adequately for high and low impact conditions, presented by the size of vehicle, the speed of impact and the angle of incidence, the barrier should be resistant to displacement under low impact conditions, and should be displaceable under high impact conditions with the extent of displacement restrained both initially and during displacement.

These objectives are achieved in accordance with this invention by having the panels of the barrier components laterally spaced from each other, and by having the ballast material between the panels resting on and engaging with the supporting surface.

The frictional engagement between the ballast material and the supporting surface will provide the necessary resistance during displacement both when the barrier is at rest, and while the barrier is being displaced laterally under impact.

Without such frictional engagement, the barrier components would be too readily displaceable for effective use under the conditions normally required. In addition, without such frictional engagement, as where the component is anchored to the supporting surface, the initial resistance to displacement would tend to be too high for average requirements, while once the anchoring means is sheared or released on impact, the resistance to further displacement would tend to be too low for effective use under average roadway and median or roadside conditions.

The apparatus 10 comprises a plurality of panels 14 which are adapted to be arranged in barrier component pairs in two generally parallel spaced rows 16 and 18 as shown in FIG. 1 along lower edges 20 of the panels 14 on a supporting surface 11 to define a filler cavity 22 between them for housing a displaceable ballast material such as sand [not shown in FIGS. 1–2] to provide a medium for dissipating impact energy during use and to support the barrier components and the barrier 12 when formed. The apparatus 10 further comprises panel connection means 26 to be engaged with the panels 14 to locate two such rows 16 and 18 in their laterally spaced relationship, and to connect the panels 14 in each row in end-to-end relationship to form an elongated linked row as shown in FIG. 2.

The panels 14 are adapted, when connected in the rows 16 and 18, to present outer surfaces 28 which are smooth and free of outwardly projecting obstructions in at least one direction parallel to the length of each linked row 16 and 18.

The panels are thus assembled so that the smooth outer surface 28 of each row will be in the direction of traffic flow on the adjacent highway flanked by that row.

The apparatus 10 is further such that when the panels 14 have been assembled and when a displaceable ballast material is housed in the filler cavity 22, the barrier 12 will provide a lower zone 30 adjacent the lower edge 20, which provides a lesser impact resistance under impact than a central impact zone 31 of each row above the lower zone 30.

Each panel 14 is formed out of 14 gauge mild steel sheet which has a tensile strength to allow deformation of the panel but resist penetration of the panel under the average type of impact which will be provided by a vehicle during use.

Each panel 14 comprises an upper panel section 13 and a lower panel section 15, with each panel section having corrugating formations 17 along one elongated edge zone. The corrugating formations 17 of the upper and lower panels 13 and 15 are overlapped to form the panels 14 and to form the central impact zones 31 which are thus reinforced in the primary impact zones 31 by the corrugating formations and also by the overlap of the corrugating formations 17.

As shown in the drawings, the upper and lower panel sections 13 and 15 are preferably corresponding panel sections so that any panel section may be used either as an upper panel section 13 or a lower panel section 15.

It will be appreciated, however, that the upper and lower panel sections 13 and 15 may differ, in which case different upper and lower panel sections will have to be manufactured. Differing upper and lower panel sections 13 and 15 may be required for a particular applications of the invention such as, for example, where a barrier component of increased height while still presenting a relatively low central impact zone 31 is required.

As shown in the drawings, each panel 14 has its central impact zone 31 bulged outwardly relatively to its upper zone and relatively to its lower zone 30.

This provides the advantage that an average vehicle which strikes the barrier 12, will strike against the central impact zone 31 to deform the panels 14 in that zone before coming into contact with either the upper zone or the lower zone 30 of the panel.

This provides certain substantial advantages for the barrier illustrated in the drawings.

By having the upper zone of each panel 14 recessed relatively to its central impact zone 31, the width of the upper portion of the barrier 12 is reduced relatively to its width in the central impact zone 31. This provides the advantage that the stability of the barrier 12 under impact is improved and that the center of gravity of the barrier 12 will be in the region of the central impact zone 31. Because of this and because contact between the upper zone of the barrier 12 and an impacting vehicle is delayed until the central impact zone 31 has been deformed by the impact, the upper zone will provide a lesser impact resistance to an impacting vehicle since the speed of the vehicle will have been attenuated by the impact before the vehicle comes into contact with the upper zone of the barrier 12.

There will therefore be a lesser tendency for contact between an impacting vehicle and the upper zone of the barrier 12 to tend to overturn the barrier 12. This arrangement will therefore encourage lateral displacement of the barrier under high impact with the barrier remaining substantially vertical, thereby combatting the tendency for an impacting vehicle to ride over the barrier.

Because of these advantages, even if the upper panel section 13 does not correspond to the lower panel section 15, the upper panel section 13 will still be manufactured so as to provide the recessed upper zone relatively to the central impact zone.

The recessed lower zone 30 provides a significant advantage for the barrier 12 illustrated in FIGS. 1 and 2 of the drawings.

An average passenger vehicle usually has its center of gravity at a height of between about 20 and 25 inches. When such a vehicle strikes a roadway barrier, the point of maximum impact is therefore spaced above the base of the barrier.

Therefore, if the lower region of the barrier below the point of impact presents an impact resistance which is the same as or greater than the impact resistance provided by the impact zone of the barrier, an impact will usually tend to cause displacement or deformation of the lower region of the barrier in a direction outwardly relatively to the direction of displacement or deformation of the central impact zone of the barrier.

Such relative displacement will give rise to the lower portion of the barrier being deformed into a ramp relatively to the remainder of the barrier. Such a ramp will have the effect of tending to direct an impacting vehicle in an upward direction.

This is a serious disadvantage since this ramping effect can cause an impacting vehicle to be propelled over the barrier and/or can cause an impacting vehicle to be overturned.

If the barrier were to have an outer surface which is planar in the vertical direction, the lower edge of the barrier which is in contact with the supporting surface, will have a greater resistance to lateral displacement than the remainder of the barrier under impact, thereby inevitably giving rise to a ramping effect under impact.

The barrier 12 of this invention as illustrated in FIGS. 1 and 2 of the drawings, is therefore adapted to provide a lesser impact resistance in the lower zone 30 than the impact resistance provided by the central impact zone 31 of the barrier above the lower zone 30.

In the embodiment illustrated in FIGS. 1 and 2, the lesser impact resistance of the lower zone is provided by each panel 14 having its lower zone 30 recessed inwardly relatively to the central impact zone 31.

In a preferred embodiment of the invention, the recessed lower zone may have a height of about 12 inches, which is less than the average height of a vehicle bumper, and a recessed depth of between about 5 and 10 inches.

By having the lower zones 30 laterally recessed relatively to the central impact zones 31, the lower zones 30 provide a lesser impact resistance and cannot come into contact with an impacting vehicle until substantial deformation of the impact zones of the panels 14 has occurred. This provides the advantage that not only will the ramping effect of the lower zones 30 be reduced but, if the lower zones 30 are deformed into a ramping configuration under impact, they will not come into contact with an impacting vehicle until its speed has been substantially attenuated by impact with the central impact zones 31 thereby substantially reducing, if not totally preventing, the generation of a ramping effect.

Applicants further believe by having the lower zones 30 recessed relatively to the central impact zones 31, this will have the effect of reducing the tendency of the barrier 12 to topple under high impact, and encourage lateral displacement of the barrier 12 under high impact while the barrier 12 maintains an essentially vertical orientation.

The recessing of the lower zones 30 further facilitates provision of the center of gravity of the barrier 12 at a height appropriate for the center of gravity of average vehicles striking the barrier 12.

In a preferred embodiment as illustrated in FIGS. 1 and 2, the lower zones 30 will be recessed sufficiently to insure that before the central impact zones 31 have been deformed sufficiently under impact to allow the lower zones 30 to come into contact with an impacting vehicle under high impacts, preferential lateral displacement of the barrier as a whole will occur thereby effectively combatting any ramping effect being provided by the lower zone 30.

The corrugating formations 17 improves the beam strengths of the panels thereby facilitating displacement of an impacting vehicle along the length of the barrier 12 and improving the resistance of the panels 14 to penetration by such an impacting vehicle. In addition, by virtue of the arrangement of the corrugating formation 17, they will tend to engage the leading end of a vehicle coming into contact with the barrier 12 thereby restraining lifting of the leading end of such a vehicle and therefore combatting ramping or overturning of such a vehicle.

The increased beam strength provided by the corrugations allows resistance to impact to build up quickly along the length of the barrier 12 thereby combatting penetration by an impacting vehicle and thereby permitting pivotal displacement of a vehicle under impact and thus smooth re-direction of the vehicle along the length of the barrier 12.

By means of the corrugating formation 17, adequate penetration resistance can be provided without the need to unduly increase the wall thickness of the panels 14. This provides the advantages that the panels 14 can be deformed under impact to gradually attenuate vehicle speed while the panels remain sufficiently light to facilitate handling during transportation, erection or dismantling. In addition, this will insure that the cost of the panels will be within acceptable limits for use as roadway barriers.

Each panel has a height of about 42 inches and a length of 9½ feet, while the rows 16 and 18 are spaced laterally to provide a maximum width of about 40 inches for the barrier 12.

Each panel 14 has an inturned flange 32 along its lower edge 20 which is directed inwardly during use, each lower flange 32 being such as to be capable of being engaged by the displaceable ballast material when housed in the filler cavity 22 to support the pairs of panels 14 of each barrier component and restrain lifting of the panels 14 relatively to the supporting surface 11 under impact and thus restrain overturning of the portion of the barrier 12 under impact during use.

Each lower flange 32 further serves to reinforce each panel 14 longitudinally.

Each panel 14 further has an inwardly directed longitudinal stiffening flange 34 along its upper edge.

Each panel 14 further has panel fitting zones in the form of fitting apertures 35 formed in the panels 14 at opposed ends for cooperating with the panel connection means 26.

The sets of panel fitting apertures 35 at opposed ends of each panel 14 are arranged complementarily to each other to allow mating with sets of panel fitting apertures 35 of a corresponding panel 14 when positioned at either end of that panel.

When the panels 14 are assembled, each panel 14 has its one edge containing the apertures 35, marginally overlapped with the adjacent edge of the succeeding panel 14 thereby insuring that there are no gaps between adjacent panels 14 in the rows 16 and 18, and thereby insuring that the rows 16 and 18 will present a surface which is smooth and free of outwardly projecting obstructions in the direction of traffic flow in the adjacent highway. It follows that overlapping of the panels 14 will be in opposed directions in the two rows 16 and 18 for opposed flow in the two adjacent highways flanking the barrier 12 provided along the highway median.

In the embodiment illustrated in FIGS. 1 and 2, the panel connection means 26 comprises a bulkhead panel 36 for each pair of panels 14 of each barrier component of the barrier 12.

Each bulkhead panel 36 is made of sheet material, conveniently sheet metal, and has its opposed sides which extend vertically during use, of complementary configuration to the overall configurations of the panels 14 to mate therewith for maintaining the pairs of panels 14 of each barrier component in their appropriate laterally spaced relationship.

Each bulkhead panel 36 has a sufficient tensile strength to maintain the pair of panels 14 of each barrier component substantially in their appropriate laterally spaced relationship even after impact. However, the bulkhead panels 36 have limited compression strength thereby permitting collapsing of the bulkhead panels 36 under impact thereby insuring that the panel connection means 26 will not, after impact, present obstructions which tend to project beyond the impact deformed surfaces of the panels 14. Thus the panel connection means 26 will not tend to interfere with smooth redirection of an impacting vehicle along the length of the barrier 12.

Each bulkhead panel 36 has its opposed verticle edges bent transversely to the plane of the panel to provide transversely extending flanges 38.

Each flange 38 is provided with appertures 39 which are complementary to the panel fitting apertures 35 for alignment therewith.

The panel connection means 26 further comprises, for each bulkhead 36, a pair of locking pins 40 and a plurality of locking brackets 42.

Each locking bracket 42 has an enlarged head portion 43, a shank 44 extending from the head portion 43 and an aperture 46 in each shank 44 for cooperating slidably with a locking pin 40.

In use, for assembly of the apparatus 10, the panels 14 will be positioned in their appropriate positions on a supporting surface 11 whereafter the panels 14 of adjacent barrier components will be overlapped to align their fitting apertures 35. A bulkhead panel 36 will then be positioned in the overlapped zone with its apertures 39 in alignment with the apertures 35. Locking brackets 42 will then be inserted through the aligned apertures, whereafter a locking pin 40 will be threaded through the aligned apertures 35 and 39 at the top of the barrier 12, and then through the apertures 46 in the locking brackets 42. Thereafter overlapped panels 14 can be connected to the opposed side of the bulkhead panel 36 in the same way. This operation is continued with further sets of panels 14 until a barrier 12 of a desired length has been formed.

The assembled barrier 12 may then be filled with a displaceable ballast material in the form of sand.

The apparatus 10 further includes a lid panel 48 for each barrier component (as shown in FIG. 1 ).

Each lid panel 48 is shaped to cover a barrier component, and has a length corresponding to the length of the panels 14 so that the lid panels of successive barrier components will overlap.

Each lid panel 48 is provided with a pair of screws 50 which can be screwed into bores provided in the upper ends of the locking pins 40 to locate the lid panels 48 in position.

It will be appreciated that various other means may be employed to cover the top of the barrier 12 to prevent excessive quantities of water entering the barrier and thereby affecting the displacement characteristics of the ballast material under impact. Thus, for example, a sheet material such as of synthetic plastics material may be used for the same purpose.

When panels 14 have become damaged under impact, they may be replaced by removing the locking pins 40, removing the locking brackets 42 and then inserting new panels to replace the damaged panels. Depending upon the extent of damage, it may be necessary to remove some or a substantial part of the ballast material before the damaged panels are removed and replaced with new panels.

In the same way, where the barrier 12 is used as a temporary roadway barrier such as, for example, in motor racing, the barrier 12 may be dismantled after use by removing the locking pins 40, removing the locking brackets 42 and then removing the panels 14. If desired, prior to dismantling of the barrier 12, the ballast material may conveniently be removed by utilization of a particulate material suction apparatus of any suitable type.

The locking pins 40 are preferably of a deformable material to permit deformation under impact. Because the bulkhead panels 36 have low compressive strengths, because the locking pins 40 are of deformable material, and because the panel connection means 26 is spaced inwardly of the outer surface of the central impact zone 31, the panel connection means 26 will tend to be collapsed under impact without coming into direct contact with an impacting vehicle thereby insuring that the panel connection means 26 will not constitute an obstruction to the smooth redirection of an impacting vehicle along the length of a formed barrier 12.

The barrier 12 as illustrated in FIGS. 1 and 2 of the drawings, provides the further advantages that the panels 14 can be nested for handling, storage and transportation, that the panels 14 are relatively light and can be readily handled during assembly and disassembly. In addition, the barrier 12 can readily be erected when required and can be filled with a conveniently available ballast material. The barrier can then readily be repaired when damaged under impact and, if the barrier is to be removed, the barrier can be dismantled rapidly and effectively, can be transported to a new site, and can then be assembled for further use.

The barrier 12 provides the further advantage that since the panels 14 are deformable in the impact zone, they can deform under impact to absorb impact energy. After deformation of the panels 14 in the impact zone, further impact energy will be absorbed by displacement of the ballast material and, under high impacts, by lateral displacement of the barrier itself over a limited distance. The barrier can therefore provide for gradual attenuation of the speed of an impacting vehicle, pivotal displacement of an impacting vehicle into contact with the barrier, and smooth redirection of an impacting vehicle along the length of the barrier.

The barrier therefore provides the essential advantages of minimizing damage to impacting vehicles and to the occupants of such vehicles while at the same time reducing the tendency for an impacting vehicle to be deflected back onto the roadway, to be deflected over the barrier 12 onto an adjacent roadway, or to be overturned.

Figure 3:
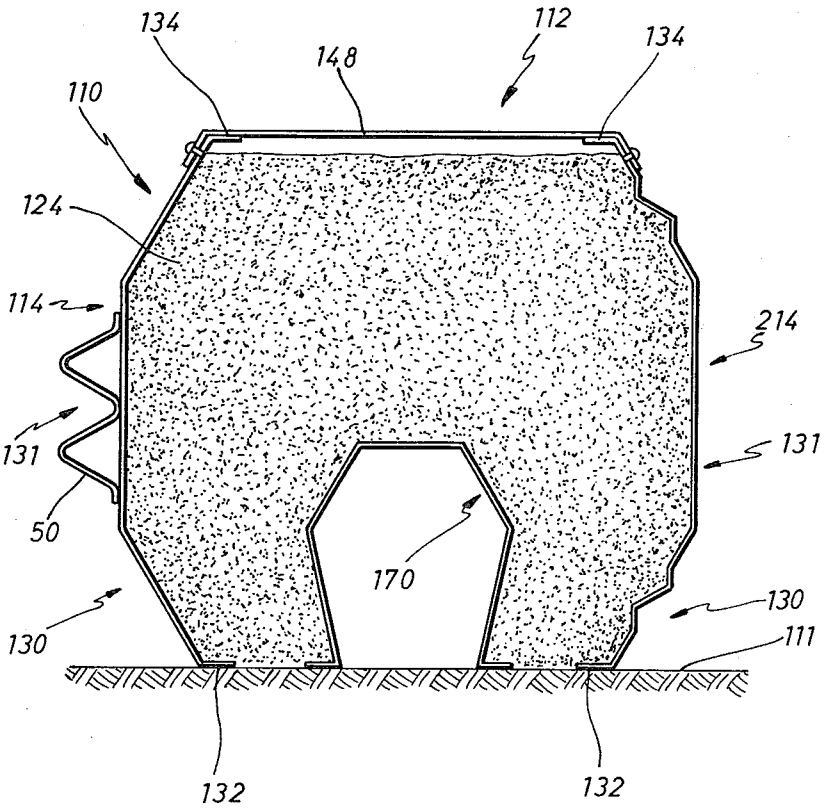
FIG. 3 shows a diagramatic end elevation of an alternative embodiment of apparatus in accordance with this invention, in an assembled condition and containing a displaceable ballast material with, for ease of illustration, two alternative types of panels defining the opposed sides of the formed barrier.
Figure 4:
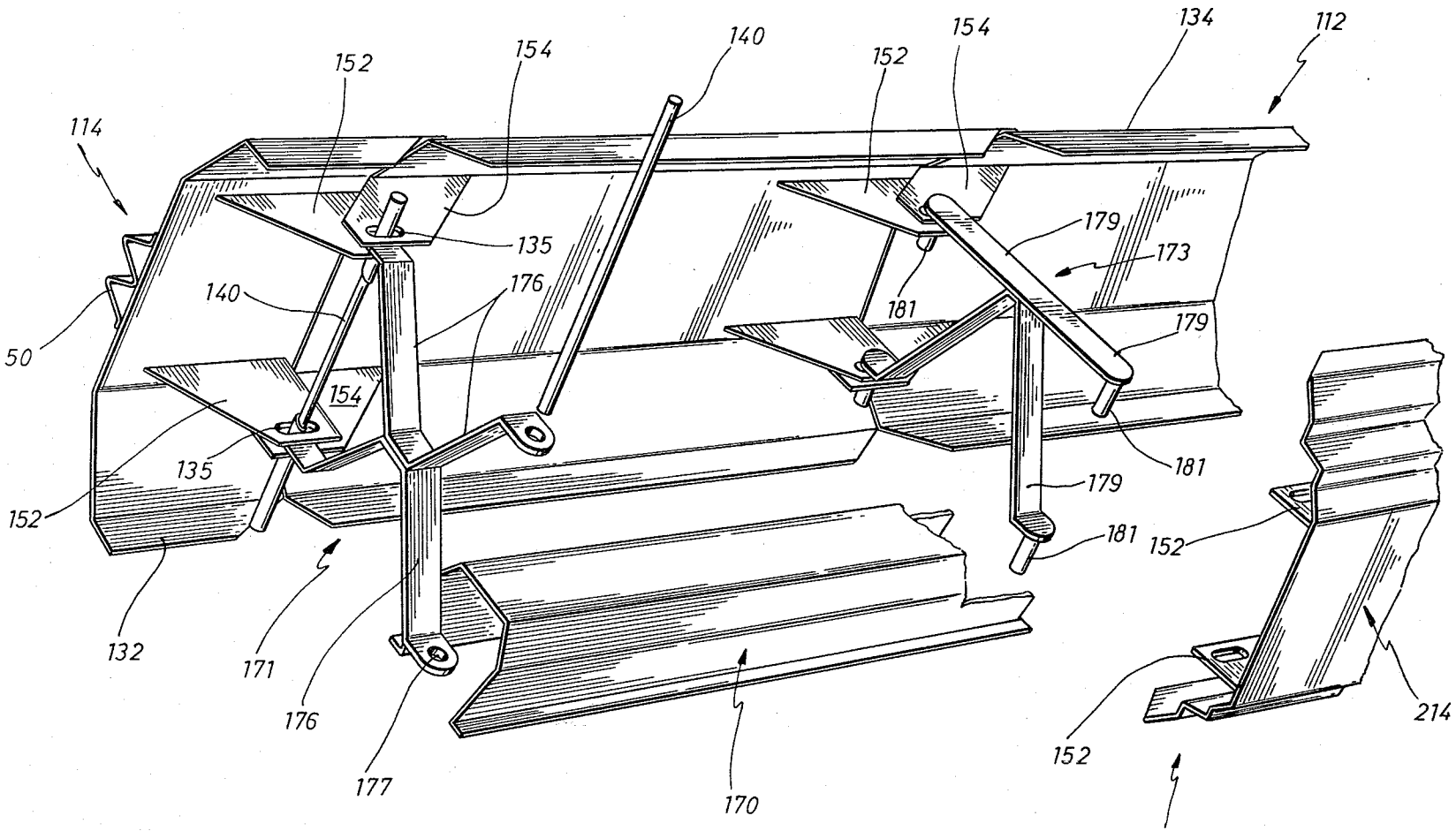
FIG. 4 shows a fragmentary, partly exploded, three-dimensional view of the apparatus of FIG. 3 but with the ballast material omitted and, for ease of illustration, with two alternative forms of panel connection means.

With reference to FIGS. 3 and 4 of the drawings, reference numeral 110 refers generally to an alternative embodiment of apparatus in accordance with this invention for forming an alternative form of roadway barrier 112.

The apparatus 110 corresponds generally with the apparatus 10 and corresponding parts are indicated by corresponding reference numerals except that the prefix "1" has been included in the reference numerals for ease of reference.

The apparatus 110 includes additional means for ensuring that the barrier 112 has a lower zone 130 which has a resistance to displacement under impact which is less than that of a central impact zone 131 of the barrier 112 above the lower zone.

In the apparatus 110, the apparatus includes collapsing means 170 for causing preferential collapsing of the lower zone 130 under impact.

The collapsing means 170 comprises a hollow tubular collapsing member which is placed on the support surface 111 along the central region of the barrier 112 prior to placing the ballast material 124 in the filler cavity 122.

The collapsing means comprises a plurality of elongated collapsing members 170 which are placed in end-to-end relationship along the entire length of the barrier.

Each collapsing member 170 is made of light gauge sheet metal which has a sufficient strength to bear the weight of the ballast material 124 without collapsing.

The collapsing members 170 provide the advantage that they reduce the quantity of ballast material in the lower zone 130 and, in addition, are readily collapsible under impact.

Thus, in use, when an impacting vehicle strikes the barrier 112, the collapsing members 170 will collapse inwardly thereby insuring that the resistance to displacement of the lower zones 130 are substantially less than that of the remainder of the barrier 112.

In this way any ramping effect as a result of impact is again avoided.

The dimensions of the collapsing member 170 are such that the center of gravity of the barrier 112 will again be at a height approaching that or marginally above the average height of the center of gravity of vehicles for which the barrier 112 is designed.

In the embodiment illustrated in these drawings, the center of gravity will be at a height of about 26 inches.

In FIGS. 3 and 4, the panels along opposed sides of the barrier 112 have been shown in two alternative forms. This has been done for convenience only since, in practice, the panels of a barrier will usually be corresponding.

The panels along one side of the barrier have been indicated by reference numeral 114, whereas those along the opposed side of the barrier have been indicated by reference numeral 214.

The panels 114 have a profile in the vertical direction to provide a central zone of each panel which bulges outwardly to provide the primary impact zone 131 for an impacting vehicle. In addition, the impact zone 131 is reinforced by means of a W-section panel 50 which is mounted thereon.

The panels 214 have a similar bulge but differ in that they are not provided with reinforcing panels. However, corrugations are provided between the bulging portion and the upper and lower portions of the panels to facilitate collapsing of the panels 214 under impact.

The apparatus 110 includes panel connection means differing from the connection means of the apparatus 10. For convenience two alternative forms of connection means have been shown.

In the apparatus 110, the one form of panel connection means has been indicated by reference 171 whereas the other form of panel connection means has been indicated by reference numeral 173.

The connection means 171 comprises two generally channel section link members 176 which are integrally joined along their base walls to provide four radially extending arms. Each arm has a bore 177 at its end for slidably receiving a locking pin 140.

The panels have complementarily arranged pairs of panel fittings in the form of single brackets 152 and 154 at their opposed ends with vertically alignable slots 135.

The locking pins 140 are slidably inserted into the aligned slots to connect opposed pairs of panels together in their laterally spaced relationship, and to connect adjacent panels in the rows of the barrier 112 in end-to-end linked relationship.

In the apparatus 110, the locking pins 140 are positioned in positions adjacent the inner surfaces of the panels 114 or 214, as the case may be.

Therefore, to avoid the locking pins 140 projecting beyond the outer surface plane of a panel in an impact zone along the panel after deformation of the panel in the impact zone upon impact, the locking pins 140 have deformable portions having a resistance to deformation generally approaching that of the panels. Thus, upon deformation of the panels under impact, the locking pins will be deformed in a corresponding manner.

Figure 7:
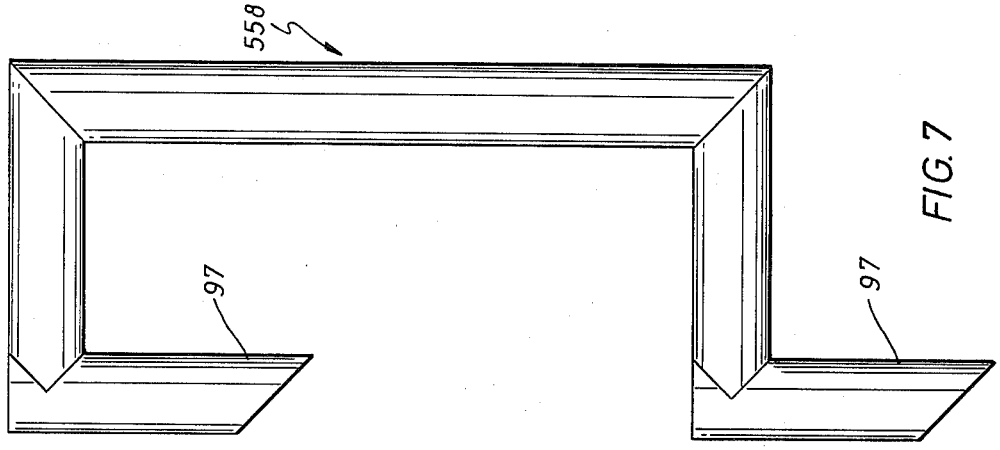
FIGS. 5, 6 and 7 show, to an enlarged scale, diagramatic views of alternative embodiments of locking pins to form part of the panel connection means of the apparatus illustrated in FIG. 4.
Figure 6:
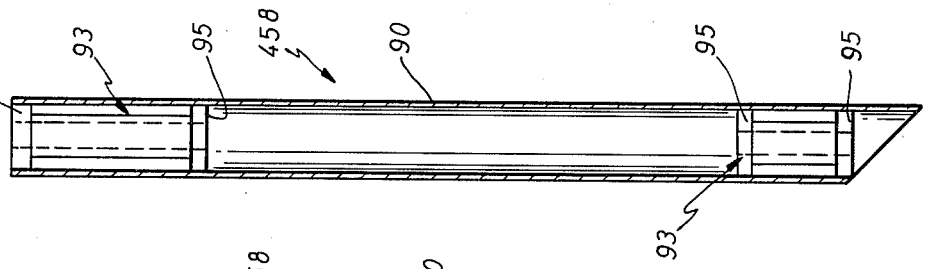
Figure 5:
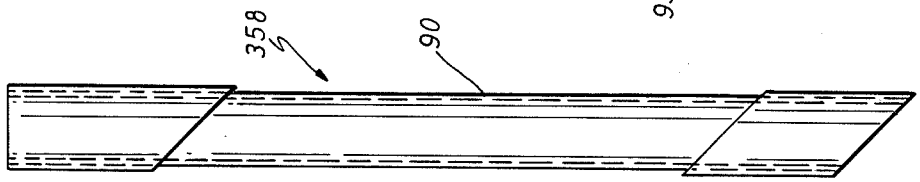

Alternative forms of locking pins to the locking pins 140 are illustrated in FIGS. 5–7 and will be described in detail below.

Insofar as the panel connection means 173 is concerned, it again has four radially extending arms 179.

Each arm 179 has a locking pin 181 depending from its free end.

The locking pins can thus be engaged with aligned slots 135 for connecting the panels.

It will be appreciated that the locking pins 181 may be shaped into hook formations if desired to provide a more positive engagement.

With the connection means 173, the pairs of locking pins 181 at opposed ends are vertically spaced and would therefore, in use, be above and below the inpact line of a vehicle impacting against the barrier 112 thereby achieving the objective of avoiding the tendency for the connection means to constitute a bar to the sliding displacement of an impacting vehicle along the barrier 112.

In addition, the arms 179 are deformable thereby permitting deformation of the connection means 173 upon impact.

With reference to FIGS. 5 and 6 of the drawings, reference numerals 358 and 458 refer generally to alternative forms of locking pins which can be employed in the connection means 171.

Each locking pin 358 and 458 comprises a tubular sleeve 90 which has a resistance to deformation corresponding generally with that of the panels.

The sleeve 90 of the locking pin 358 has thick-walled locating sleeves mounted at opposed ends thereof for engaging in the slots 135 as illustrated in the left-hand side of the connection means 171.

The locking pin 458 has rigid spools 93 positioned within its opposed ends.

Each spool 93 has transversely extending flanges 95 at its opposed ends.

When the sleeve 90 is deformed under impact, the flanges 95 will tend to combat withdrawal of the brackets from the locking pin 458.

In the embodiment illustrated in FIG. 7 of the drawings, reference numeral 558 refers generally to a locking pin suitable for use with the connection means 171.

The locking pin 558 has two laterally offset engagement pins 97 for engagement in the slots 135 of the brackets illustrated in the apparatus 110. The main body portion of the locking pin 558 is therefore displaced laterally and inwardly of the panels of the barrier 112 to achieve the same objective.

It will be appreciated that positive locking means may be provided for the locking pins to positively locate them in the slots against withdrawal under impact and that, for removal of a panel, the yieldable portions of the locking pins can be severed to permit withdrawal.

It will be appreciated by those skilled in the art that various modifications and alterations can be made to specific features of the invention without departing from the essential concepts of this invention.

We claim:

1. A roadway barrier component adapted to be assembled on a supporting surface with corresponding barrier components removably connected to opposed ends thereof for forming an elongated dismountable roadway barrier for flanking a roadway, the barrier being deformable under vehicle impact to gradually redirect a straying vehicle coming into contact therewith, the barrier component comprising:

(a) a pair of panels to be positioned along a lower edge of each panel on such a supporting surface in laterally spaced relationship to define a filler cavity between their internal surfaces for receiving a displaceable ballast material to support the component on such a supporting surface and to provide a medium for dissipating impact energy during use;

(b) panel connection means for use in removably connecting the panels together in their laterally spaced relationship;

(c) each panel having panel fitting zones for use in removably connecting the panels of the barrier component to panels of corresponding barrier components to form an elongated roadway barrier having at least one elongated outer surface which is generally smooth and free of outwardly projecting obstructions in at least one direction parallel to the length of the barrier;

(d) the barrier component being adapted to provide a lesser impact resistance in a lower zone than in a central impact zone of the barrier component during vehicle impact therewith to combat vehicle ramping; and (e) the central impact zone of at least one panel being formed to provide an elongated beam stiffness along the length of the panel to distribute an impact force along the length of the panel during use and thus encourage re-direction of an impacting vehicle along the length of the barrier.

2. A component according to claim 1, in which the component is so adapted to provide a lower zone of lesser impact resistance by at least one panel having its lower zone recessed inwardly of its central impact zone to delay contact between the lower zone and a vehicle striking the barrier during impact.

3. A component according to claim 1 or claim 2, in which the component is so adapted to provide a lower zone of lesser impact resistance by the component including collapsing means for causing preferential collapsing of the lower zone under impact.

4. A component according to claim 3, in which the collapsing means comprises a collapsible material to be located between the panels in the lower region during use, the collapsible material having a resistance to displacement which is less than that of a ballast material to be provided in the filler cavity.

5. A component according to claim 1 or claim 2, in which the panels are corresponding panels.

6. A component according to claim 1, in which the central impact zone of the panel is reinforced to provide resistance to penetration under impact.

7. A component according to claim 6, in which the central impact zone of the panel is reinforced to increase the wall thickness of the panel in the impact zone.

8. A component according to claim 7, in which the panel comprises upper and lower panel sections with each section having corrugating formations along one elongated edge zone, and in which the corrugating formations are overlapped to form the reinforced corrugated central impact zone of the panel.

9. A component according to claim 1, in which each panel has an inturned flange proximate its lower edge to be directed inwardly during use for supporting the panel displaceably on a supporting surface, each flange being such as to be capable of being engaged by ballast material to restrain lifting of a panel under impact during use.

10. A component according to claim 1, in which the panel connection means is adapted to cooperate with the panel fitting zones for use in removably connecting the panels together and for removably connecting the panels of the component to panels of corresponding barrier components.

11. A component according to claim 1 or claim 10, in which the panel connection means is such as to limit its affect upon a vehicle striking the component and deforming a panel of the component during use.

12. A component according to claim 11, in which the connection means has at least one deformable portion having a resistance to deformation generally approaching that of the panels.

13. A component according to claim 1, in which the panel fitting zones comprise spaced sets of apertures proximate opposed end regions of each panel for engagement by the panel connection means.

14. A component according to claim 13, in which the panel connection means comprises at least one connection link member to extend between the panel fitting zones at one end of the pair of laterally spaced panels, and locking pins to lock the link member in position.

15. A component according to claim 14, in which the locking pins are adapted to be displaced in a direction extending transversely to the bottom edge of the panels during insertion and during withdrawal.

16. A component according to claim 14, in which the link member comprises a connecting unit having a plurality of arms to cooperate with the panel fitting zones at one end of the pair of panels.

17. A component according to claim 10, in which the panel connection means comprises a bulkhead panel having opposed sides to be engaged with the panels.

18. A component according to claim 1, in which each panel has an inwardly directed stiffening flange along its upper edge, and in which the component includes a lid panel to close the upper end of the component for use.

19. Apparatus for forming on a supporting surface an elongated dismountable roadway barrier for flanking a roadway, which is deformable under vehicle impact to gradually deflect a straying vehicle coming into contact therewith, the apparatus comprising:

(a) a plurality of panels adapted to be arranged in two generally parallel laterally spaced rows along lower edges of the panels on such a supporting surface to define a filler cavity between them for housing a displaceable ballast material to support the roadway barrier when formed and provide a medium for dissipating impact energy, and (b) panel connection means to be engaged with the panels for locating two such rows in their spaced relationship, and for connecting the panels in each row in end-to-end relationship to form an elongated linked row;

at least the panels to be placed in one row being adapted, when connected, to present an outer surface for the row which is generally smooth and free of outwardly projecting obstructions in at least one direction parallel to the length of the linked row;

the apparatus when assembled and when housing a ballast material in the filler cavity, being adapted to provide a lesser impact resistance in a lower zone adjacent the lower edge than in a central impact zone in at least one linked row during vehicle impact therewith to combat vehicle ramping; and at least the panels to be placed in one row each having a central impact zone formed to provide beam stiffness which is continuous along the length of the panel to distribute an impact force along the length of the panel during use and thus encourage re-direction of an impacting vehicle along the length of the barrier.

20. Apparatus according to claim 19, in which the apparatus is so adapted by each panel for that row having a lower zone adjacent its lower edge recessed inwardly to delay contact between the lower zone and a vehicle striking the barrier during impact.

21. Apparatus according to claim 19 or claim 20, in which the apparatus is so adapted to provide such a lower zone by the apparatus including collapsing means for causing preferential collapsing of the lower zone under impact.

22. Apparatus according to claim 21, in which the collapsing means comprises collapsing material to be housed in the lower region of the filler cavity during use, the collapsing material having a resistance to displacement which is less than that of ballast material to be housed in the filler cavity.

23. Apparatus according to claim 19, in which all of the panels are corresponding panels.

24. Apparatus according to claim 23, in which the panels are shaped to be nestable for stacking and transportation.

25. Apparatus according to claim 19, in which the panels are reinforced in the impact zones to provide resistance to penetration under impact.

26. Apparatus according to claim 25, in which each panel comprises upper and lower panel sections with each section having at least one corrugating formation along one elongated edge zone, and in which the corrugating formations are overlapped to form the reinforced corrugated central impact zones of the panels.

27. Apparatus according to claim 19, in which each panel has an inturned flange proximate its lower edge to be directed inwardly during use, each flange being such as to be capable of being engaged by ballast material to restrain lifting of the panels of the erected barrier under impact during use.

28. Apparatus according to claim 19, in which the connection means are such as to limit their affect upon a vehicle striking the barrier and deforming the barrier during use.

29. Apparatus according to claim 28, in which each connection means has at least one deformable portion having a resistance to deformation generally approaching that of the panels.

30. Apparatus according to claim 19, in which the panel connection means comprise connection link members to extend between the panel fittings at one end of each pair of laterally spaced panels, and locking pins to lock the link members in position.

31. Apparatus according to claim 30, in which each panel connection means comprises a bulkhead panel having opposed sides to be engaged with the panels.

32. Apparatus according to claim 19, in which some of the panels are curved transversely to their lengths to allow formation of a roadway barrier which has angularly related portions along its length.

33. An elongated dismountable roadway barrier positioned on a supporting surface to flank a roadway, the barrier being deformable under impact to gradually redirect a straying vehicle striking the barrier, the barrier comprising:

(a) a plurality of panels arranged in two generally parallel spaced rows along lower edges of the panels to define a filler cavity between them;

(b) connection means engaged with the panels thereby locating the rows in their laterally spaced relationship, and connecting the panels in each row in end-to-end relationship in an elongated linked row with the barrier presenting outer surfaces which are generally smooth in a direction parallel to the length of the barrier to allow a vehicle striking the barrier to be deflected along the length of the barrier;

(c) a displaceable ballast material housed in the filler cavity to support the barrier and provide a medium for dissipating impact energy;

(d) collapsing means in a lower region of the barrier adjacent its lower edge to cause the lower region of a row to collapse preferentially to a central region of that row above the lower region upon impact; and (e) the panels of at least one row each having a central impact zone formed to provide beam stiffness which is continuous along the length of the panel to distribute an impact force along the length of the panel during use and thus encourage re-direction of an inpacting vehicle along the length of the barrier.

34. A roadway barrier according to claim 33, in which the panels of at least one row are connected to provide beam stiffness extending along the length of the barrier.

35. A roadway barrier component adapted to be assembled on a supporting surface with corresponding barrier components removably connected to opposed ends thereof for forming an elongated dismountable roadway barrier for flanking a roadway, the barrier being deformable under vehicle impact to gradually redirect a straying vehicle coming into contact therewith, the barrier component comprising:

(a) a pair of panels to be positioned along a lower edge of each panel on such a supporting surface in laterally spaced relationship to define a filler cavity between their internal surfaces for receiving a displaceable ballast material to support the component on such a supporting surface and to provide a medium for dissipating impact energy during use;

(b) panel connection means for removably connecting the panels together in their laterally spaced relationship;

(c) each panel having panel fitting zones for use in removably connecting the panels of the barrier component to panels of corresponding barrier components to form an elongated roadway barrier having at least one elongated outer surface which is generally smooth and free of outwardly projecting obstructions in at least one direction parallel to the length of the barrier;

(d) at least one panel having a central impact zone having a greater beam strength than a lower zone to allow for preferential collapsing of the lower zone under impact to combat vehicle ramping, and to encourage re-direction of an impacting vehicle along the length of the panel during use by distributing impact force along the length of the panel.

36. A roadway barrier component adapted to be assembled on a supporting surface with corresponding barrier components removably connected to opposed ends thereof for forming an elongated dismountable roadway barrier for flanking a roadway, the barrier being deformable under vehicle impact to gradually redirect a straying vehicle coming into contact therewith, the barrier component comprising:

(a) a pair of panels to be positioned along a lower edge of each panel on such a supporting surface in laterally spaced relationship to define a filler cavity between their internal surfaces for receiving a displaceable ballast material to support the component on such a supporting surface and to provide a medium for dissipating impact energy during use;

(b) panel connection means for removably connecting the panels together in their laterally spaced relationship;

(c) each panel having panel fitting zones for use in removably connecting the panels of the barrier component to panels of corresponding barrier components to form an elongated roadway barrier having at least one elongated outer surface which is generally smooth and free of outwardly projecting obstructions in at least one direction parallel to the length of the barrier;

(d) the barrier component being adapted to provide a lesser impact resistance in a lower zone than in a central impact zone of the barrier component during vehicle impact therewith to combat vehicle ramping; and (e) the component being so adapted to provide a lower zone of lesser impact resistance by the component including collapsing means for causing preferential collapsing of the lower zone under impact.

37. A component according to claim 36, in which the collapsing means comprises a collapsible material to be located between the panels in a lower region during use, the collapsible material having a resistance to displacement which is less than that of a ballast material to be provided in the filler cavity.

38. A roadway barrier component adapted to be assembled on a supporting surface with corresponding barrier components removably connected to opposed ends thereof for forming an elongated dismountable roadway barrier for flanking a roadway, the barrier being deformable under vehicle impact to gradually redirect a straying vehicle coming into contact therewith, the barrier component comprising:

(a) a pair of panels to be positioned along a lower edge of each panel on such a supporting surface in laterally spaced relationship to define a filler cavity between their internal surfaces for receiving a displaceable ballast material to support the component on such a supporting surface and to provide a medium for dissipating impact energy during use;

(b) panel connection means for removably connecting the panels together in their laterally spaced relationship;

(c) each panel having panel fitting zones for use in removably connecting the panels of the barrier component to panels of corresponding barrier components to form an elongated roadway barrier having at least one elongated outer surface which is generally smooth and free of outwardly projecting obstructions in at least one direction parallel to the length of the barrier;

(d) at least one panel having a central impact zone which is bulged outwardly relatively to its upper and lower zones to constitute a primary impact zone for that panel during use.

39. A component according to claim 38, in which the central impact zone is positioned so that, when the component is filled with a displaceable ballast material, the center of gravity of the component will be in the region of or above the central impact zone.

40. A component according to claim 38, in which the central impact zone is positioned so that, in use, it will be at a height generally corresponding to the height of the center of gravity of an average passenger vehicle.

41. A roadway barrier component adapted to be assembled on a supporting surface with corresponding barrier components removably connected to opposed ends thereof for forming an elongated dismountable roadway barrier for flanking a roadway, the barrier being deformable under vehicle impact to gradually redirect a straying vehicle coming into contact therewith, the barrier component comprising:

(a) a pair of panels to be positioned along a lower edge of each panel on such a supporting surface in laterally spaced relationship to define a filler cavity between their internal surfaces for receiving a displaceable ballast material to support the component on such a supporting surface and to provide a medium for dissipating impact energy during use;

(b) each panel having panel fitting zones for use in removably connecting the panels of the barrier component to panels of corresponding barrier components to form an elongated roadway barrier having at least one elongated outer surface which is generally smooth and free of outwardly projecting obstructions in at least one direction parallel to the length of the barrier;

(c) at least one panel comprising upper and lower panel sections with each section having at least one corrugating formation along one elongated edge zone, and with the corrugating formations being overlapped to form a corrugated central impact zone of that panel.

42. A component according to claim 41, which further comprises panel connection means for use in removably connecting the panels together in their laterally spaced relationship.

43. A component according to claim 42, in which each panel section has a plurality of corrugating formations which are overlapped to form the central impact zone.

44. A roadway barrier component adapted to be assembled on a supporting surface with corresponding barrier components removably connected to opposed ends thereof for forming an elongated dismountable roadway barrier for flanking a roadway, the barrier being deformable under vehicle impact to gradually redirect a straying vehicle coming into contact therewith, the barrier component comprising:

(a) a pair of panels to be positioned along a lower edge of each panel on such a supporting surface in laterally spaced relationship to define a filler cavity between their internal surfaces for receiving a displaceable ballast material to support the component on such a supporting surface and to provide a medium for dissipating impact energy during use;

(b) panel connection means for removably connecting the panels together in their laterally spaced relationship;

(c) each panel having panel fitting zones for use in removably connecting the panels of the barrier component to panels of corresponding barrier components to form an elongated roadway barrier having at least one elongated outer surface which is generally smooth and free of outwardly projecting obstructions in at least one direction parallel to the length of the barrier;

(d) the panel connection means having at least one deformable portion having a resistance to deformation generally approaching that of the panels to limit its effect upon a vehicle striking the component and deforming a panel of the component during use.

45. A component according to claim 1, in which the central impact zone of each panel having such an impact zone, is bulged outwardly relatively to its upper and lower zones to form a primary impact zone.

46. A component according to claim 1, in which the central impact zone of each panel having such a zone is positioned relatively to the panel's upper and lower zones to place the center of gravity of the component when filled with displaceable ballast material, in the region of or above the central impact zone.

47. A component according to claim 1, in which each central impact zone is positioned at a height corresponding generally with the height of the center of gravity of an average passenger vehicle.

48. A component according to claim 1, in which the beam stiffness of the central impact zone is provided by a bulge formation in the central impact zone.

49. A component according to claim 48, in which the bulge formation comprises a corrugation formation along the central impact zone.

50. A component according to claim 49, in which the bulge formation comprises a plurality of corrugation formations along the central impact zone.

51. A component according to claim 49, in which the corrugation formation is integrally formed in the panel.

52. A component according to claim 49, in which the corrugation formation is formed by means of a reinforcing strip which is fixed to the panel.

53. A component according to claim 49, in which the panel comprises upper and lower panel sections with each section having at least one corrugation formation along one elongated edge zone, and in which the corrugation formations are overlapped to form the central impact zone of the panel.

54. A component according to claim 48, in which the bulge formation is arranged to be engaged by a vehicle during impact to restrain the vehicle front from lifting.

55. A component according to claim 54, in which the bulge formation comprises at least one corrugation formation.

56. A component according to claim 1, in which the beam stiffness of the central impact zone is provided by reinforcing along the impact zone.

57. Apparatus according to claim 19, in which the panels are adapted to be connected in end-to-end relationship in each row for the impact zones to provide beam stiffness which is continuous along the length of the barrier when formed.

58. Apparatus according to claim 19, in which the panels are adapted to be connected in end-to-end relationship in each row for the impact zones of the panels to provide beam stiffness extending from one panel to the next to distribute impact force along the length of the barrier during use.

* * * * *